US009738996B2

(12) United States Patent
Yamagami et al.

(10) Patent No.: US 9,738,996 B2
(45) Date of Patent: Aug. 22, 2017

(54) SHEET MANUFACTURING APPARATUS

(71) Applicant: SEIKO EPSON CORPORATION, Tokyo (JP)

(72) Inventors: Toshiaki Yamagami, Shiojiri (JP); Yoichi Miyasaka, Suwa (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/126,612

(22) PCT Filed: Mar. 18, 2015

(86) PCT No.: PCT/JP2015/001513

§ 371 (c)(1),
(2) Date: Sep. 16, 2016

(87) PCT Pub. No.: WO2015/146080

PCT Pub. Date: Oct. 1, 2015

(65) Prior Publication Data

US 2017/0081794 A1 Mar. 23, 2017

(30) Foreign Application Priority Data

Mar. 25, 2014 (JP) ..... 2014-061391
Dec. 8, 2014 (JP) ..... 2014-247689

(51) Int. Cl.

| | |
|---|---|
| ***D21C 5/02*** | (2006.01) |
| ***D04H 1/732*** | (2012.01) |
| ***D21B 1/06*** | (2006.01) |
| ***D21G 9/00*** | (2006.01) |

(52) U.S. Cl.

CPC ..... *D04H 1/732* (2013.01); *D21B 1/06* (2013.01); *D21C 5/02* (2013.01); *D21G 9/0009* (2013.01)

(58) Field of Classification Search

CPC . D04H 1/732; D21B 1/06; D21C 5/02; D21G 9/0009

USPC ..... 162/263

See application file for complete search history.

(56) References Cited

U.S. PATENT DOCUMENTS

2014/0027075 A1 1/2014 Yamagami et al.
2014/0374047 A1 12/2014 Yamagami
2015/0275435 A1* 10/2015 Seki ..... D21H 17/20 162/5

(Continued)

FOREIGN PATENT DOCUMENTS

JP 2012-144819 A 8/2012

OTHER PUBLICATIONS

International Search Report dated Apr. 14, 2015 for PCT/JP2015/001513.

*Primary Examiner* — Mark Halpern
(74) *Attorney, Agent, or Firm* — Workman Nydegger

(57) ABSTRACT

A sheet manufacturing apparatus can determine if the sheets supplied as feedstock have already been recycled.

The sheet manufacturing apparatus has a supply unit configured to supply feedstock; a defibrating unit configured to defibrate the feedstock; an depositing unit configured to deposit defibrated material defibrated by the defibrating unit; a forming unit configured to form a sheet from a web laid by the depositing unit; a marking unit configured to apply a mark to at least one of the web and the sheet; and a reading unit configured to read the mark imparted to the feedstock when a sheet having mark imparted thereto is supplied as the feedstock.

6 Claims, 3 Drawing Sheets

(56) References Cited

U.S. PATENT DOCUMENTS

2016/0010278 A1 1/2016 Yamagami et al.
2016/0326696 A1* 11/2016 Seki ..... D21H 17/20

* cited by examiner

SHEET MANUFACTURING APPARATUS

The entire disclosures of Japanese Patent Application No. 2014-061391, filed Mar. 25, 2014, and Japanese Patent Application No. 2014-247689, filed Dec. 8, 2014, are expressly incorporated by reference herein.

TECHNICAL FIELD

The present invention relates to a sheet manufacturing apparatus.

BACKGROUND

A paper recycling system having a dry defibrating unit that shreds and defibrates paper, a first conveyance unit that conveys the defibrated material defibrated by the dry defibrating unit, an air classifier that classifies and deinks the defibrated material conveyed by the first conveyance unit, a second conveyance unit that conveys the defibrated material de-inked by the classifier, and a paper-forming unit that forms paper from the defibrated material conveyed by the second conveyance unit is known from the literature (see, for example, PTL 1).

CITATION LIST

Patent Literature

[PTL 1] JP-A-2012-144819

SUMMARY OF INVENTION

Technical Problem

When paper used as the feedstock is defibrated, however, the fibers become shorter. When the recycled paper is again defibrated, the fibers become even shorter. The strength of paper that contains much short fiber tends to decrease, and a problem with the system cited above is that it cannot determine whether or not the paper feedstock supplied to the system is paper that was previously recycled.

Solution to Problem

The present invention is directed to solving at least part of the foregoing problem, and can be embodied as described in the following embodiments and examples.

EXAMPLE 1

A sheet manufacturing apparatus according to the invention includes: a supply unit configured to supply feedstock; a defibrating unit configured to defibrate the feedstock; a depositing unit configured to deposit defibrated material defibrated by the defibrating unit; a forming unit configured to form a sheet from a web laid by the depositing unit; a marking unit configured to apply a mark to at least one of the web and the sheet; and a reading unit configured to read the mark imparted to the feedstock when a sheet having mark imparted thereto is supplied as the feedstock.

This configuration can manufacture sheets with mark imparted to a web laid by a depositing unit or a sheet formed by a forming unit. When sheet having such imparted mark is again supplied as feedstock to the sheet manufacturing apparatus, the mark on the sheet is read by a reading unit.

The supplied sheets can then be recognized as having been previously defibrated (having been recycled).

EXAMPLE 2

The sheet manufacturing apparatus described above, characterized by the marking unit being disposed to at least one of the depositing unit and the forming unit.

By disposing the marking unit to the depositing unit or forming unit, this configuration can impart the mark easily.

EXAMPLE 3

The sheet manufacturing apparatus described above, characterized by the mark being an embossment with a protrusion(s) or indent (s) in the surface of the sheet; and the reading unit reading the embossment.

By reading the protrusion (s) or indent (s) imparted to the sheet, this configuration can easily determine if the sheet was previously defibrated.

EXAMPLE 4

The sheet manufacturing apparatus described above, characterized by the mark being a part with different density than other parts of the sheet; and the reading unit reading the part with different density.

By reading the part with different density in the sheet, this configuration can easily determine if the sheet was previously defibrated.

EXAMPLE 5

The sheet manufacturing apparatus described above, characterized by the mark imparted to the sheet by the marking unit differing from the mark on the feedstock.

By making the mark imparted to the new sheet formed by defibrating supplied sheet (s) different from the marks on the sheets supplied as feedstock, this configuration can determine how many times the feedstock was defibrated (recycled).

EXAMPLE 6

The sheet manufacturing apparatus described above, characterized by the marking unit forming the mark on both front and back sides of the sheet.

Because marks are formed on both sides of the sheet, the reading unit in this configuration can read the mark regardless of which side is facing the reading unit when the sheets are supplied as feedstock.

DESCRIPTION OF EMBODIMENTS

First and second embodiments of the invention are described below with reference to the accompanying figures. Note that parts are shown in the accompanying figures in sizes enabling easy recognition thereof, and differ from the actual scale of the actual parts.

Embodiment 1

The configuration of s sheet manufacturing apparatus is described first below. The sheet manufacturing apparatus is based on technology for forming a new sheet Pr from feedstock Pu (undefibrated material) such as virgin pulp paper and recovered paper. A sheet manufacturing apparatus according to this embodiment includes a supply unit that supplies feedstock; a defibrating unit that defibrates the feedstock; a depositing unit that lays the defibrated material defibrated by the defibrating unit; a forming unit that forms sheets from the web laid by the depositing unit; a marking unit that applies a mark (or marks) to at least one of the sheet and the web; and a reading unit that reads the mark(s) applied to the feedstock when marked sheets are supplied as feedstock. The configuration of the sheet manufacturing apparatus is further described below.

Figure 1:
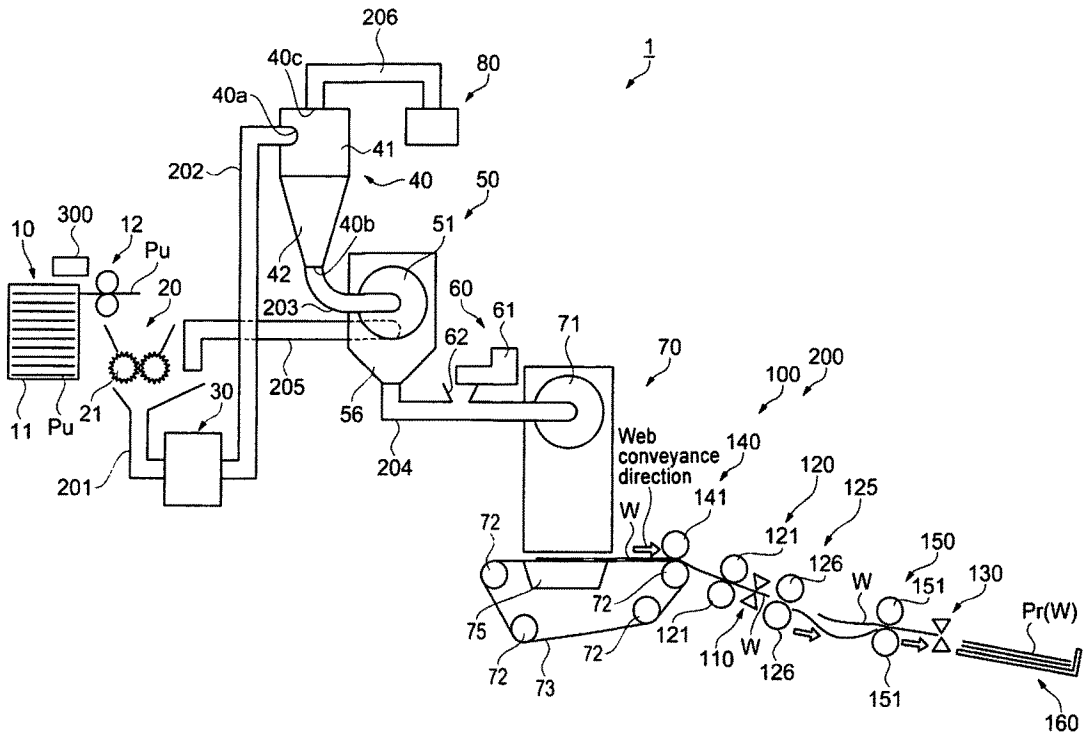
FIG. 1 illustrates the configuration of a sheet manufacturing apparatus according to a first embodiment of the invention.

FIG. 1 illustrates the configuration of a sheet manufacturing apparatus according to this embodiment. As shown in FIG. 1, the sheet manufacturing apparatus 1 of this embodiment includes a supplying unit 10, shredder 20, defibrating unit 30, classifier 40, separator 50, additive agent feed unit 60, depositing unit 70, forming unit 200, a marking unit and a reading unit 300, and a controller that controls these other parts.

The supply unit 10 supplies recovered paper Pu as the feedstock to the shredder 20. The supply unit 10 includes a tray 11 for stocking a stack of sheets of recovered paper Pu, and an automatic sheet feeder 12 for continuously supplying the recovered paper Pu in the tray 11 to the shredder 20. A4 office paper such as typically used in business is an example of the recovered paper Pu that is supplied to the sheet manufacturing apparatus 1. This embodiment also has a marking unit and a reading unit 300 for reading mark(s) applied to the recovered paper Pu that is supplied to the shredder 20. The detailed configuration of the marking unit and the reading unit 300 is described below.

The shredder 20 cuts the recovered paper Pu that is supplied into pieces a few centimeter square. The shredder 20 has shredder blades 21, and is configured similarly to a common office shredder but with a wider shredding width. This enables easily cutting the recovered paper Pu that is supplied into shreds of a suitable size. The shredded paper is then conveyed through a conduit 201 to the defibrating unit 30.

The defibrating unit 30 has rotary blades that turn (not shown in the figure), and defibrates the shredded paper supplied from the shredder 20 into fibers. Note that herein the material to be defibrated by the defibrating unit 30 is referred to as undefibrated material, and the material that has passed through the defibrating unit 30 is referred to as defibrated material. Note that the defibrating unit 30 in this embodiment of the invention defibrates the shredded paper in a dry process in air. As a result of the defibration process of the defibrating unit 30, ink and toner used for printing, sizing agents, and other coating materials applied to the paper are reduced to particulate several ten microns or less in diameter (referred to below as "ink particles"), and separated from the fibers. The defibrated material output from the defibrating unit 30 is thus the fibers and ink particles obtained by defibration of the shredded paper. The defibrating unit 30 also produces an air current by rotation of the rotary blades, and the defibrated fiber is conveyed in air by this air current through a conduit 202 to the classifier 40. Note that a separate blower that produces an air flow carrying the defibrated fiber through the conduit 202 to the classifier 40 may be separately disposed to the defibrating unit 30 as required.

The classifier 40 classifies material supplied to the classifier 40 in air. In this example, the classifier 40 separates defibrated material as the supplied material into ink particles and fiber. By using a cyclone unit, the classifier 40 can separate the conveyed fiber into ink particles and deinked fibers (deinked defibrated material) by an air classification process. Note that an air classifier other than a cyclone may be used. In this event, an elbow-jet or eddy classifier, for example, may be used as the air classifier instead of a cyclone. An air classifier produces a helical air flow, and separates and classifies by means of the differences in centrifugal force resulting from the size and density of the defibrated material, and the cut point can be adjusted by adjusting the speed of the air flow and the centrifugal force. As a result, relatively small, relatively low density ink particles can be separated from the fibers that are larger and more dense than the ink particles. Removing the ink particles from the fibers is referred to as "deinking."

The classifier 40 in this embodiment of the invention uses a tangential inlet cyclone, and comprises an inlet port 40*a* through which feedstock is introduced from the defibrating unit 30; a cylindrical cyclone body 41 to which the inlet port 40*a* is tangentially attached; a conical section 42 continuing from the bottom of the cyclone body 41; a lower discharge port 40*b* disposed to the bottom of the conical section 42; and an upper discharge port 40*c* disposed to the top center of the cyclone body 41 for discharging fine particulate. The diameter of the conical section 42 decreases from top to bottom.

In the classification process, the air flow carrying the defibrated material introduced from the inlet port 40*a* of the classifier 40 is converted by the cyclone body 41 and conical section 42 to a circular motion, and is classified by the applied centrifugal force. Deinking progresses as the fibers, which are larger and denser than the ink particles, move to the lower discharge port 40*b* while the relatively small, low density ink particles are carried by the airflow to the upper discharge port 40*c* as dust. A short fiber mixture containing a large amount of ink particles is then discharged from the upper discharge port 40*c* of the classifier 40. The short fiber mixture containing a large amount of discharged ink particles is then recovered through a conduit 206 connected to the upper discharge port 40*c* of the classifier 40 into a receiver 80. The classified material containing the fiber is then conveyed from the lower discharge port 40*b* of the classifier 40 through a conduit 203 toward the separator 50. The material may be conveyed from the classifier 40 to the separator 50 by the air flow from classification, or conveyed by gravity from the upper classifier 40 to the lower separator 50. Note that a suction unit for efficiently suctioning the short fiber mixture from the upper discharge port 40*c* may also be disposed to the upper discharge port 40*c* of the classifier 40 or the conduit 206, for example.

The separator 50 selectively passes the classified material containing fiber that was classified by the classifier 40 through numerous holes. More specifically, the separator 50 separates the classified material including fiber that was classified by the classifier 40 into passed material that passes through the apertures, and remnants that do not pass through. The separator 50 in this embodiment of the invention uses a mechanism that disperses the classified material into air by a rotary movement. The passed material that passed through the holes by the separation process of the separator 50 is received into a hopper 56 and then conveyed through a conduit 204 to the forming unit 70. The remnants that did not pass through the holes in the separation process of the separator 50 are returned to the defibrating unit 30 through another conduit 205 as the conveyance path as undefibrated material again. As a result, the remnants are recycled (reused) instead of being discarded as waste.

The passed material that passed through the holes in the separation process of the separator 50 is conveyed by air through the conduit 204 to the depositing unit 70. Material may be conveyed by a blower not shown that produces an air flow from the separator 50 to the depositing unit 70, or be conveyed by gravity from the separator 50 above to the depositing unit 70 below. An additive agent feed unit 60 for adding an additive such as a resin (a fusion bonding resin or thermosetting resin, for example) to the passed material being conveyed is also disposed to the conduit 204 between the separator 50 and the depositing unit 70. In addition to fusion bonding resin, additives such as flame retardants, bleaching agents, paper strengtheners, and sizing agents may also be added. These additives are stored in an additive hopper 61 and introduced through a loading port 62 by a loader mechanism not shown.

The depositing unit 70 has a mechanism for uniformly distributing fiber in air, and a mechanism for laying the distributed fiber onto a mesh belt 73. A web W as used herein refers to the configuration of an object containing fiber and resin. Therefore, whether the dimensions or other aspect of the web changes during heating, compressing, cutting, or conveying, it is still referred to as a web.

A forming drum 71 into which fiber and resin are loaded is disposed to the depositing unit 70 as the mechanism for uniformly distributing the fiber in air. By rotationally driving the forming drum 71, the resin (additive) can be uniformly mixed with the passed material (fiber). A foraminous screen is disposed to the forming drum 71. By rotationally driving the forming drum 71, resin (additive) can be mixed uniformly with the passed material (fiber), and a mixture of fiber or combinations of resin and fibers that passed the holes in the screen can be uniformly distributed in air.

An endless mesh belt 73 made with mesh and tensioned by tension rollers 72 is disposed below the depositing unit 70. The mesh belt 73 moves in one direction by at least one of the tension rollers 72 turning.

A suction device 75 that produces a downward flow of air is disposed as a suction unit vertically below the forming drum 71 with the mesh belt 73 therebetween. The suction device 75 pulls the fibers suspended in air down onto the mesh belt 73.

The fiber and other material that passed through the foraminous screen of the forming drum 71 are deposited onto the mesh belt 73 by the suction power of the suction device 75. By moving the mesh belt 73 in one direction, the fibers and resin can be deposited to forma continuous web W. A web W containing continuously deposited fiber and resin can be formed by moving the mesh belt 73 in one direction. A web W formed in a continuous ribbon is formed by continuous distribution from the forming drum 71 and movement of the mesh belt 73. Note that the mesh belt 73 may be made of metal, plastic, or nonwoven cloth, and may be configured in any way enabling fibers to accumulate thereon and air to pass therethrough. The suction device 75 can be constructed by forming an air-tight box with a window of a desirable size below the mesh belt 73, and pulling air in through the window so that the pressure inside the box is lower than the ambient pressure. Note that a web W according to this embodiment of the invention refers to the configuration of an object containing fibers and resin. The web W is therefore still referred to as a web W even if the size or other aspect of its form changes by heating, compressing, cutting, conveying or other manipulation of the web W. Therefore, references to a web W also include a sheet Pr as described below.

The web W formed on the mesh belt 73 is conveyed by the conveyance unit 100. The conveyance unit 100 in this embodiment denotes conveyance of the web W from the mesh belt 73 to final deposition as a sheet Pr (web W) in the stacker 160. In addition to the mesh belt 73, various rollers therefore also function as part of the unit 100. The conveyance unit many be variously configured with at least one conveyor belt or conveyance roller. More conveyance specifically, the web W formed on the mesh belt 73, which is part of the conveyance unit 100, is conveyed in the conveyance direction (indicated by the arrow in the figures) by rotational movement of the mesh belt 73. Next, the web W is conveyed from the mesh belt 73 in the conveyance direction (indicated by the arrows in the figure). Note that in this example the range downstream from the depositing unit 70 in the conveyance direction of the web W in which a sheet Pr is formed from the web W laid by the depositing unit 70 is associated with the forming unit 200.

A compression unit is disposed on the downstream side of the depositing unit 70 in the conveyance direction of the web W. The compression unit in this embodiment of the invention is a compression unit 140 comprising a roller 141 that applies pressure to the web W. The web W can be compressed by passing the web W between the roller 141 and tension roller 72. As a result, the strength of the web W can be improved.

A pre-cutter roller 120 is disposed on the downstream side of the compression unit 140 in the conveyance direction of the web W. The pre-cutter roller 120 comprises a pair of rollers 121. Of the rollers 121, one is the drive roller and the other is a driven roller.

A cutting unit 110 that cuts the web W transversely to the conveyance direction of the conveyed web W is disposed on the downstream side of the pre-cutter roller 120 in the conveyance direction of the web W. The cutting unit 110 has a cutter and cuts the continuous web W into leaves (sheets) at a cutting position set to a specific length. The cutting unit 110 may use a rotary cutter, for example. This enables cutting while conveying the web W. Productivity can therefore be improved because conveyance of the web W is not stopped for cutting. Note that the cutting unit 110 is not limited to a rotary cutter, and other types of cutters may be used.

A post-cutter roller 125 is disposed on the downstream side of the cutting unit 110 in the conveyance direction of the web W.

A pair of heat rollers 151 embodying a heat unit 150 are disposed on the downstream side of the post-cutter roller 125 in the conveyance direction of the web W. The heat unit 150 bonds (binds) the fibers contained in the web W through the resin. A heater or other type of heating member is disposed in the axial center of the heat rollers 151, and heat and pressure can be applied to the conveyed web W by passing the web W between the pair of heat rollers 151. By applying heat and pressure to the web W with the pair of heat rollers 151, the resin melts and becomes more easily interlaced with the fibers, the distance between fibers becomes shorter, and the number of points of contact between the fibers increases. As a result, density increases and web W strength is improved. The heat unit 150 applies heat and pressure so that the thickness of the web W is reduced to from approximately ⅕ to ⅒ the thickness of the web W before passing through the heating/compression process. A marking unit that imparts a mark (or marks) to the web W is also disposed to the heat unit 150 in this embodiment. The configuration of the marking unit is described below in detail.

A second cutting unit 130 that cuts the web W in the conveyance direction of the web W is disposed on the downstream side of the heat unit 150 in the conveyance direction of the web W. The second cutting unit 130 has a cutter, and cuts at a specific cutting position in the conveyance direction of the web W. As a result, a sheet Pr (web W) of a desired size is formed. The cut sheet Pr (web W) is then stacked in a stacker 160, for example.

A sheet in this embodiment of the invention refers primarily to sheet products that are manufactured from feedstock containing recovered paper, virgin pulp paper, or other type of fiber. The feedstock is not so limited, however, and may be in the form of paperboard or web (or corrugated). The feedstock may also be cellulose or other type of plant fiber, synthetic fiber such as PET (polyethylene terephthalate) and polyester, or wool, silk, or other animal fiber. Sheets as referred to herein are separated into paper and nonwoven cloth. Paper includes thin sheets, recording paper for handwriting and printing, wall paper, packaging paper, color paper, and bristol paper, for example. Nonwoven cloth includes products that are thicker or have lower strength than paper, and includes nonwoven cloth, fiberboard, tissue paper, kitchen paper, cleaning paper, filter paper, liquid absorption materials, sound absorption materials, cushioning materials, and mats, for example.

Recovered paper as used in this embodiment of the invention mainly refers to paper that has been previously printed on, but any paper product that is used as feedstock is considered recovered paper whether or not the paper was actually used.

Figure 2:
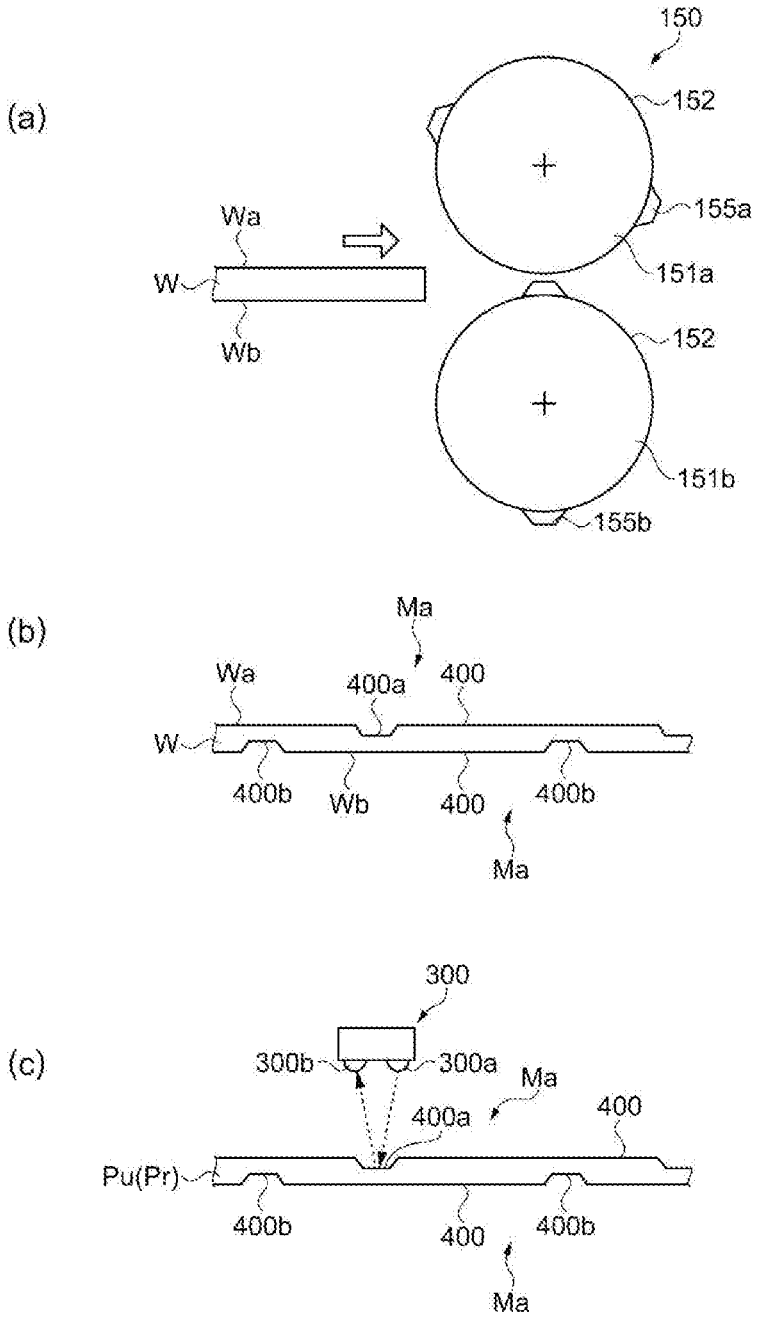
FIG. 2 illustrates the configuration of the marking unit and reading unit in the first embodiment of the invention.

The configuration of the marking unit and the reading unit are described next. FIG. 2 illustrates the configuration of the marking unit and reading unit according to this embodiment, FIG. 2 (*a*) showing the configuration of the marking unit, FIG. 2 (*b*) showing the appearance of the web W after marks are formed, and FIG. 2 (*c*) showing the configuration of the reading unit. The marking unit is disposed to at least one of the depositing unit and the forming unit. This embodiment describes a configuration having the marking unit disposed to the forming unit.

The mark formed by the marking unit in this example is an embossment with protrusion(s) or indent(s) in the surface of the sheet. The marking unit is disposed in this example to the heat unit 150 that is part of the forming unit 200. The marking unit in this embodiment is a configuration that imparts the mark (embossment) in both the front and back sides of the sheet. More specifically, as shown in FIG. 2 (*a*), protrusions are disposed as the marking units on the surface 152 of the heat rollers 151 embodying the heat unit 150. More specifically, protrusions 155*a* are disposed to the surface 152 of one heat roller 151*a*. Protrusions 155*b* are likewise disposed to the surface 152 of the other heat roller 151*b*. The protrusions 155*a* and protrusions 155*b* are disposed so they will not touch, and the pair of heat rollers 151 is configured to turn at the same speed.

The web W is held and compressed (heated and compressed) between the pair of heat rollers 151. As a result, the resin contained in the web W melts, fibers are bound together through the resin, and the web W is compressed. At the same time, indents conforming to the shape of the protrusions 155*a*, 155*b* are formed in the surface 400 of the web W, and as shown in FIG. 2 (*b*), an embossed web W is formed with indents 400*a*, 400*b* in the web surface 400. The web W in this example is thus formed with mark Ma comprising indents 400*a* in one surface Wa of the web W, and mark Ma comprising indents 400*b* in the other surface Wb of the web W. The indents 400*a* in the one surface Wa, and the indents 400*b* in the other surface Wb, are formed alternating in the conveyance direction of the web W.

Note that the mark Ma is raised or recessed embossment in the surface of the web W, and the size, depth, number, and other aspects of the protrusions and indents can be determined as desired. This can be done by desirably configuring the shape of the protrusions 155*a*, 155*b* formed on the heat rollers 151*a*, 151*b* to the desired shape of the mark Ma. For example, if a recess is formed in the surfaces 152 of the pair of heat rollers 151, the web W can be embossed with a raised relief. If protrusions 155*a* are formed in one heat roller 151, and a recess is formed in the other heat roller 151 at a position corresponding to the protrusions 155*a*, an indent will be formed in the one surface Wa of the web W while a raised relief will be formed on the other surface Wb. Where the mark Ma is formed in the web W (sheet Pr) can also be determined as desired. This can be done by appropriately forming the protrusions 155*a*, 155*b* of the heat rollers 151 at positions corresponding to the desired locations of the mark Ma. The locations of the mark Ma are desirably set to positions not affecting how the final sheets Pr may be used, such as along an edge of the sheet Pr. Note that the protrusions 155*a*, 155*b* are shown large in FIG. 2 for clarity, but are preferably as small as possible insofar as the mark Ma can be read by the marking unit and the reading unit 300 described below. Most preferably, the mark is indent(s) and relief(s) that are not obvious to the naked eye.

The heat rollers 151 may be aluminum, iron, stainless steel, or other metal, or an elastic material such as silicon rubber or urethane rubber may be used. Further alternatively, of the pair of heat rollers 151, one heat roller 151 may be metal and the other heat roller 151 may be an elastomer.

The web W with embossment mark Ma is then cut by the second cutting unit 130. As a result, a sheet Pr with embossment mark Ma is formed.

The configuration of the reading unit is described next. When sheets with mark are supplied as the feedstock, the reading unit reads the mark applied to the feedstock. When a sheet Pr embossed with mark Ma is supplied as the recovered paper Pu (feedstock), the reading unit 300 reads the embossment mark formed in the sheet Pr (recovered paper Pu). By reading the embossment, the supplied feedstock can be recognized as having been previously defibrated (recycled). If the embossment cannot be read, the supplied feedstock can be recognized as having not yet been defibrated (not previously recycled). As a result, whether or not the supplied feedstock has been previously defibrated or recycled can be determined. The reading unit 300 is disposed to a location where it can read the embossment mark Ma applied to the recovered paper Pu, and in this embodiment is disposed near the supplying unit 10 that supplies the recovered paper Pu to the shredder 20 (see FIG. 1).

The reading unit 300 is an optical sensor. The reading unit 300 is connected to a controller, and is driven as controlled by a specific program. The data acquired by the reading unit 300 is sent to the controller, and the controller processes the received data to determine whether or not mark(s) Ma are present.

As shown in FIG. 2 (*c*), the reading unit 300 in this example has a light source 300*a* that emits light, and a photodetector 300*b*. The light source 300*a* and photodetector 300*b* of the reading unit 300 are disposed facing the surface of the supplied recovered paper Pu. When light is emitted from the light source 300*a* to the recovered paper Pu, the emitted light is reflected from the surface of the recovered paper Pu. The reflected light is then detected by the photodetector 300*b*. The controller is configured to perform various calculations based on the time it takes the light emitted from the light source 300*a* to the recovered paper Pu to be reflected by the recovered paper Pu and detected by the photodetector 300*b*. The controller in this embodiment is configured to calculate a time difference based on time data acquired at plural times, and determines there are indents or reliefs, that is, embossment mark, if the time difference exceeds a specific threshold. For example, when embossment mark Ma are read from the recovered paper Pu, data expressing the time between when light is emitted from the light source 300*a* to the recovered paper Pu (sheet Pr), reflected by a indents 400*a*, and detected by the photodetector 300*b*, and data expressing the time between when light is emitted from the light source 300*a* to the recovered paper Pu (sheet Pr), reflected by the surface 400, and detected by the photodetector 300*b*, is sent to the controller. Based on the transmitted time data, the controller calculates the time difference, and if the time difference exceeds a specific threshold, determines there is the embossment mark Ma on the recovered paper Pu that was read. On the other hand, if the time difference is calculated based on the transmitted time data and the time difference does not exceed the specific threshold, the controller determines there is no embossment mark Ma on the recovered paper Pu that was read. Multiple locations where there may be marks on a sheet of recovered paper, and multiple locations including locations where there are no marks, are read, and if at least one mark Ma is detected, the supplied recovered paper Pu can be recognized as paper that has already been recycled (defibrated). However, if it is determined that there is not even one mark Ma, the supplied recovered paper Pu can be determined to be undefibrated recovered paper that has not been recycled even once. Note that recovered paper the sheet manufacturing apparatus 1 cannot determine to have been defibrated or recycled is handled as un-recycled paper even if it is recycled paper. For example, even if it was recycled, the nature of recovered paper that has been recycled by a device other than the sheet manufacturing apparatus 1 and has no marks is unknown. As a result, sheets that were recycled by the sheet manufacturing apparatus 1, sheets that were recycled by a sheet manufacturing apparatus of the same type as the sheet manufacturing apparatus 1, and sheets that were recycled by a sheet manufacturing apparatus with specific mark(s) at a specific location that can be read and recognized by the sheet manufacturing apparatus 1, are treated as recycled sheets.

Because embossment marks Ma are imparted to both sides Wa, Wb of the web W (sheet Pr) in this embodiment, either side of the recovered paper Pu can be read. For example, if the recovered paper has the mark Ma formed on only one side of the recovered paper Pu, the mark Ma cannot be read if the side having the mark Ma is not facing the reading unit 300. This embodiment of the invention does not require arranging the recovered paper Pu so that the marks Ma are all on the same side, and feedstock can be easily supplied.

Effects of this embodiment are described below.

By heating and compressing the web W by a pair of heat rollers 151 having protrusions 155*a*, 155*b* as a marking unit, fibers contained in the web W can be bonded by the resin and embossment mark Ma can be formed. As a result, efficiency can be improved. In addition, when recovered paper Pu having such the mark Ma is supplied to the sheet manufacturing apparatus 1, the embossment mark Ma is read by the reading unit 300. As a result, the supplied recovered paper Pu can be recognized as having been already defibrated (recycled).

Embodiment 2

A second embodiment of the invention is described next. The basic configuration of the sheet manufacturing apparatus according to this embodiment is the same as the configuration of the sheet manufacturing apparatus 1 according to the first embodiment of the invention, and further description thereof is omitted (see FIG. 1). Aspects of the configuration that differ from the first embodiment, specifically the configuration of the marking unit and reading unit, are described below. Note that this embodiment describes a configuration in which the marking unit is disposed to the depositing unit. The configuration is described specifically below.

Figure 3:
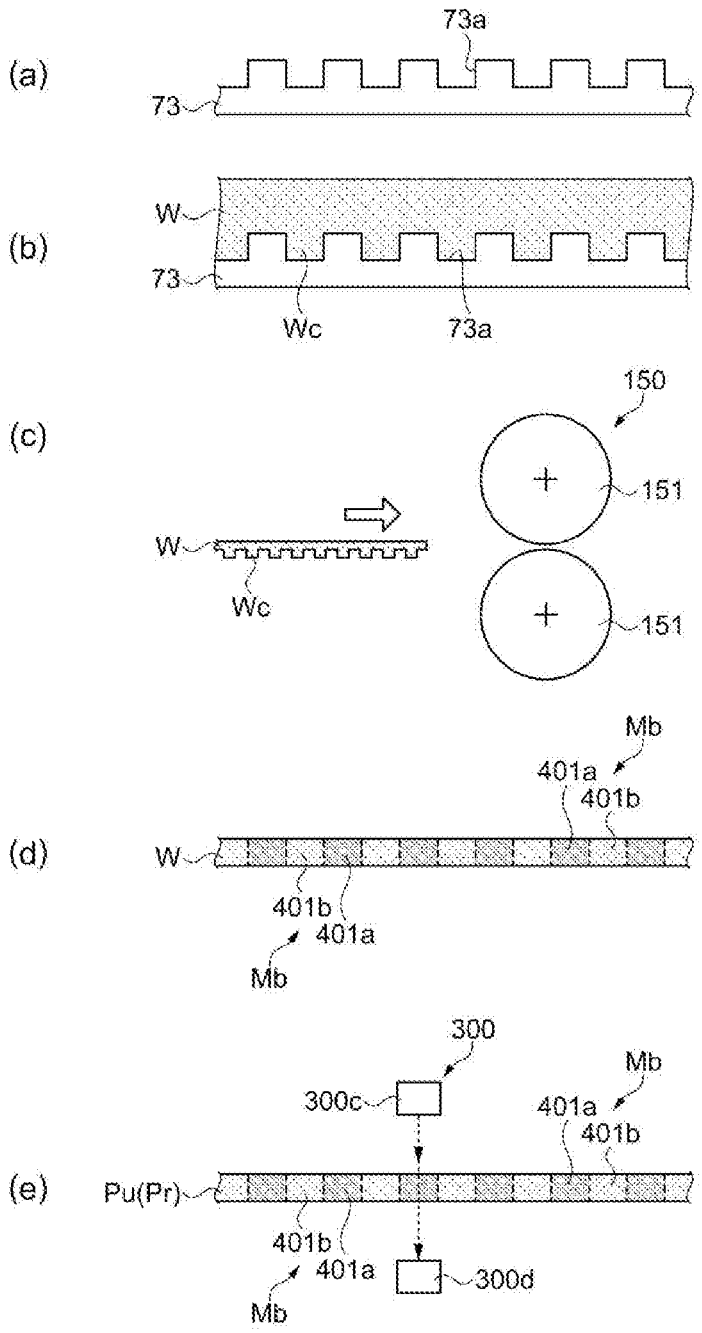
FIG. 3 illustrates the configuration of the marking unit and reading unit in a second embodiment of the invention.

FIG. 3 illustrates the configuration of the marking unit and reading unit in this embodiment, FIG. 3 (*a*) showing the configuration of the marking unit, FIG. 3 (*b*) and FIG. 3 (*c*) illustrating the process of forming the mark, FIG. 3 (*d*) showing the appearance of the web W after mark are formed, and FIG. 3 (*e*) showing the configuration of the reading unit.

The mark applied by the marking unit in this embodiment is a part that differs in density from the other parts of the sheet. In this embodiment, the marking unit according to this embodiment is disposed to the mesh belt 73 that is part of the depositing unit 70. More specifically, as shown in FIG. 3 (*a*), a recess 73*a* is formed in part of the surface of the mesh belt 73 facing the forming drum 71 (see FIG. 1) (note that a protrusion may be formed in part of the surface of the mesh belt 73).

Material including fiber and resin is laid on the mesh belt 73 after passing the forming drum 71 of the depositing unit 70, forming a web W. As shown in FIG. 3 (*b*), protrusions Wc are formed in the web W according to the shape of the recesses 73*a* in the mesh belt 73. In other words, as shown in FIG. 3 (*c*), a web W with a textured surface including the protrusions Wc is formed on one side of the web W. The web W with a textured surface including the protrusions Wc is then heated and compressed by the pair of heat rollers 151.

As a result, as shown in FIG. 3 (*d*), a web W with a mark Mb having parts of different density is formed. A mark Mb including first density parts 401*a* and second density parts 401*b* of mutually different density is formed in the web W in this embodiment. The first density parts 401*a* are the protrusions Wc of the web W corresponding to the recesses 73*a* when the fiber and other material is laid on the mesh belt 73, and the second density parts 401*b* are the parts corresponding to the portions other than the protrusions Wc in the web W. Because there is more fiber and other material compressed by the heat rollers 151 in the protrusions Wc of the web W than the parts of the web W outside the protrusions Wc, the density of the first density parts 401*a* is greater than the density of the second density parts 401*b*. In this configuration, the depositing unit 70 is the marking unit that applies the mark Mb.

Note that the mark Mb may be any part of the web W having different densities, and the size, depth, number, and other aspects of the recesses 73*a* in the mesh belt 73 can be desirably set. In this case, the shape of the recesses 73*a* in the mesh belt 73 may be desirably set according to the desired mark Mb. Where the mark Mb is formed in the web W (sheet Pr) can also be desirably set. The location and other aspects of the recesses 73*a* in the mesh belt 73 can also be desirably set according to the desired location of the mark Mb. The location of the mark Mb is preferably set to a position not affecting how the final sheets Pr may be used, such as along an edge of the sheet Pr.

The web W to which a mark Mb including first density parts 401*a* and second density parts 401*b* was imparted is then cut by the second cutting unit 130. A sheet Pr with a mark Mb is thus formed.

The configuration of the reading unit is described next. When sheets with marks are supplied as the feedstock, the reading unit reads the marks applied to the feedstock. When a sheet Pr embossed with mark Mb is supplied as the recovered paper Pu (feedstock), the reading unit 300 reads the part of the sheet Pr (recovered paper Pu) where parts with different density were formed. By reading the portion with different density areas, the supplied feedstock can be recognized as having been previously defibrated (recycled). The reading unit 300 is disposed to a location where it can read the mark Mb added to the recovered paper Pu, and in this embodiment is disposed near the supplying unit 10 that supplies the recovered paper Pu to the shredder 20 (see FIG. 1).

The reading unit 300 is an optical sensor. The reading unit 300 is connected to a controller, and is driven as controlled by a specific program. The data acquired by the reading unit 300 is sent to the controller, and the controller processes the received data to determine whether or not the mark Mb is present.

As shown in FIG. 3 (*e*), the reading unit 300 in this example has a light source 300*c* that emits light, and a photodetector 300*d*. The light source 300*c* and photodetector 300*d* are disposed on opposite sides of the recovered paper Pu so that the optical axes of the light source 300*c* and photodetector 300*d* are substantially perpendicular to the surface of the recovered paper Pu to be read. Note that the positions of the light source 300*c* and photodetector 300*d* may be reversed. When light is emitted from the light source 300*c* to the recovered paper Pu, the emitted light passes through the recovered paper Pu, and the light that passed through the recovered paper Pu is then detected by the photodetector 300*d*.

Based on the plural readings of detected light data, the controller is configured to calculate the light difference based on the plural light readings, and determine there is an area with density differences if the detected amount of light exceeds a specific threshold. For example, if a mark Mb having parts (first density parts 401*a*, second density parts 401*b*) of different density in the recovered paper Pu is read, data expressing the amount of light detected by the photodetector 300*d* receiving the light emitted from the light source 300*c* to the mark Mb and passing through the first density parts 401*a*, and data expressing the amount of light detected by the photodetector 300*d* receiving the light emitted from the light source 300*c* to the mark Mb and passing through the second density parts 401*b*, is sent to the controller. Based on the amount of light data received, the controller calculates the light difference, and if there are places where the light difference exceeds the specific threshold and does not exceed the specific threshold, determines that a mark Mb having parts of different density (first density parts 401*a*, second density parts 401*b*) was imparted to the recovered paper Pu that was scanned. If based on the amount of light data sent from the reading unit 300 the light difference is calculated and there are no places where the amount of light difference exceeds the specific threshold, the controller determines that a mark Mb having parts of different density was not imparted to the recovered paper Pu that was scanned. In other words, the controller determines that the supplied recovered paper Pu is recovered paper that has not been defibrated before. The mark Mb can be read from either side of the recovered paper Pu in this embodiment, too.

Effects of this embodiment are described below.

By laying fiber and resin on a mesh belt 73 having recesses 73*a* as the marking unit, forming a web W with protrusions Wc, and heating and compressing the web W by a heat unit 150, fibers contained in the web W can be bonded by the resin and a mark Mb with first density parts 401*a* and second density parts 401*b* of mutually different density are formed. When recovered paper Pu having a mark Mb is supplied to the sheet manufacturing apparatus 1, the parts (first density parts 401*a*, second density parts 401*b*) of different density in the mark Mb are read by the reading unit 300. As a result, the supplied recovered paper Pu can be recognized as having been already defibrated (recycled).

The present invention is not limited to the foregoing embodiment, and the foregoing embodiment can be modified and improved in many ways. Some examples are described below.

EXAMPLE 1

When mark Ma or mark Mb are formed as described in the first and second embodiments, the mark(s) imparted to the sheet by the marking unit may differ from the mark(s) imparted to the feedstock. More specifically, marks that are different than the marks Ma, Mb that were read are imparted to the defibrated web W based on the result of reading the marks Ma, Mb of the recovered paper Pu supplied as the feedstock. Marks being different means the shape of the marks changes, the size changes, or the interval between one mark and the next changes. As a result, the marking unit is preferably able to change the shape, for example. In the first embodiment above, for example, the shape or size of the protrusions 155*a*, 155*b* may be changeable, or the depth of the indents 400*a*, 400*b* may be changeable. In the second embodiment, the density difference of the first density parts 401*a* and second density parts 401*b* may be changeable. As a result, because the marks Ma, Mb of the supplied recovered paper Pu and the marks applied to newly formed sheets Pr differ, the number of times the feedstock has been defibrated can be determined. A configuration in which the reading unit 300 determines the number of times the recovered paper Pu that is supplied has been defibrated, and controls the amount of additive added to the fiber according to the number of times the feedstock was defibrated, is also conceivable. In this case, the reading unit 300 increases the amount of fiber as the number of times the supplied recovered paper Pu was defibrated increases. The length of the defibrated fibers shortens and the strength of the sheet Pr drops as the number of times the recovered paper Pu supplied to the sheet manufacturing apparatus 1 has been defibrated increases, but this example can manufacture sheets Pr with consistent strength because the amount of resin is controlled according to the number of times the supplied recovered paper Pu has been defibrated. Furthermore, because the length of the defibrated fibers shortens according to the number of times the material has been defibrated, a drop in the strength of the sheet Pr can be suppressed by adding fiber with a long fiber length.

EXAMPLE 2

The first embodiment uses a non-contact optical sensor for the reading unit 300, but the invention is not so limited.

For example, a contact-type surface roughness tester may be used. Indents 400*a* and indents 400*b* can be read using such a tester. Further alternatively, an imaging device may be used to image the mark Ma, and the mark Ma may be read by image processing the captured image data. This configuration has the same effect as described above.

EXAMPLE 3

Uniformly aligned indents 400*a* and indents 400*b* are formed in the first embodiment, but the invention is not so limited. The dimensions of the indents 400*a* and indents 400*b* may differ. Specific letters, graphics, or symbols may also be formed as the mark Ma. This can enable easily determining if the recovered paper Pu (sheet Pr) was already defibrated. The first density parts 401*a* and second density parts 401*b* in the second embodiment are formed in the same area, but the invention is not so limited and the first density parts 401*a* and second density parts 401*b* may be formed in different areas. This configuration has the same effect as described above.

EXAMPLE 4

The first embodiment has protrusions 155*a*, 155*b* as the marking unit disposed to the heat rollers 151, but the invention is not so limited. The marking unit may be disposed to the forming unit 200 somewhere other than the heat rollers 151. In this case, a marking unit that applies embossment mark Ma to the web W is disposed after heating and compression by the heat rollers (before the web W has cooled). Thus comprised, protrusions are not disposed to the heat rollers 151, and manufacturing the heat rollers 151 is simplified. Plural marking units with different shapes can also be interchanged to form different marks as described in the first example above.

EXAMPLE 5

In the first embodiment protrusions 155*a*, 155*b* are disposed as marking units to both of the pair of heat rollers 151, but the invention is not so limited. For example, protrusions 155*a* (155*b*) may be formed to only one of the pair of heat rollers 151. In this case, the mark is formed on only one side of the web W. In this case, a transmissive reading unit 300 as described in the second embodiment is preferable to a reflective reading unit 300 as described in the first embodiment. Because the part where the indents 400*a* are formed is compressed more than the other parts in the first embodiment, the density is higher. In other words, the mark Ma of the first embodiment is both embossment (s) with indent (s) and part (s) with different density.

EXAMPLE 6

The mark Ma in the first embodiment comprise indents 400*a* and indents 400*b*, but the invention is not so limited and the mark Ma may be mark with a through-hole. For example, through-holes may be formed by puncturing the sheet with a needle-like object. In this case, as in the second embodiment, a light source and a photodetector are disposed on opposite sides of the sheet, and the presence of mark Ma can be detected by detecting the light passing through the sheet. This also enables detecting if a supplied sheet was previously defibrated (recycled) as described above. Note that the mark Ma may also be printed character(s) or symbol(s).

EXAMPLE 7

The mark Mb in the second embodiment is configured with parts of two different densities, first density parts 401*a* and second density parts 401*b*, but the invention is not so limited. For example, the mark Mb may have parts with three or more different densities. This configuration has the same effect as described above.

EXAMPLE 8

The marking unit is disposed to the heat unit 150 in the first embodiment, but the invention is not so limited. A marking unit that affixes a piece of paper to the surface of the web W may be disposed to another part of the forming unit 200. The thickness of the sheet Pr where the piece of paper is affixed forms a mark that is thicker than other parts of the sheet Pr. The marking unit may also be disposed to the forming unit 200 or the depositing unit 70 as described in the first embodiment or the second embodiment. For example, the mark) can be imparted to the sheet Pr after cutting by the second cutting unit 130.

EXAMPLE 9

The first embodiment and second embodiment above describe a dry sheet manufacturing apparatus. However, the same problem addressed by the invention occurs during repeated defibration in a wet sheet manufacturing apparatus. As a result, the invention includes wet sheet manufacturing apparatuses, and defibration by defibration includes defibration by a wet defibrating unit.

EXAMPLE 10

Configurations of the first embodiment, second embodiment, and examples described above may also be used in desirable combinations.

REFERENCE SIGNS LIST

1 sheet manufacturing apparatus
10 supplying unit
20 shredder
30 defibrating unit
40 classifier
50 separator
60 additive agent feed unit
70 depositing unit
71 forming drum
73 mesh belt
73*a* recesses as marking units
80 receiver
100 conveyance unit
110 cutting unit
120 pre-cutter roller
130 second cutting unit
140 compression unit
150 heat unit
151 (151*a*, 151*b*) heat rollers
155*a* protrusions as marking units
155*b* protrusions as marking units
160 stacker
200 forming unit
300 reading unit
300*a* light source
300*b* photodetector

300*c* light source
300*d* photodetector
400*a* indents
400*b* indents
401*a* first density parts
401*b* second density parts

The invention claimed is:

1. A sheet manufacturing apparatus comprising:

a supply unit configured to supply feedstock;

a defibrating unit configured to defibrate the feedstock;

a depositing unit configured to deposit defibrated material defibrated by the defibrating unit;

a forming unit configured to form a sheet from a web laid by the depositing unit;

a marking unit configured to apply a mark to at least one of the web and the sheet; and a reading unit configured to read the mark imparted to the feedstock when a sheet having mark imparted thereto is supplied as the feedstock.

2. The sheet manufacturing apparatus described in claim 1, wherein the marking unit being disposed to at least one of the depositing unit and the forming unit.

3. The sheet manufacturing apparatus described in claim 1, wherein the mark being embossment with a protrusion or indent in the surface of the sheet; and the reading unit reading the embossment.

4. The sheet manufacturing apparatus described in claim 1, wherein the mark being a part with different density than other parts of the sheet; and the reading unit reading the part with different density.

5. The sheet manufacturing apparatus described in claim 1, wherein the mark imparted to the sheet by the marking unit differing from the mark on the feedstock.

6. The sheet manufacturing apparatus described in claim 1, wherein the marking unit forming the mark on both front and back sides of the sheet.

* * * * *